US009728867B2

(12) United States Patent
Allen

(10) Patent No.: US 9,728,867 B2
(45) **Date of Patent: *Aug. 8, 2017**

(54) MAGNETIC COUPLING SYSTEMS

(71) Applicant: Lon W. Allen, Hagerman, ID (US)

(72) Inventor: Lon W. Allen, Hagerman, ID (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/822,371

(22) Filed: Aug. 10, 2015

(65) Prior Publication Data

US 2015/0349438 A1 Dec. 3, 2015

Related U.S. Application Data

(63) Continuation of application No. 14/206,908, filed on Mar. 12, 2014, now Pat. No. 9,142,912.

(60) Provisional application No. 61/782,596, filed on Mar. 14, 2013.

(51) Int. Cl.

| | |
|---|---|
| ***H01R 11/30*** | (2006.01) |
| ***H01R 13/62*** | (2006.01) |
| ***H01R 11/28*** | (2006.01) |

(52) U.S. Cl.

CPC ..... *H01R 11/30* (2013.01); *H01R 11/281* (2013.01); *H01R 11/288* (2013.01); *H01R 13/6205* (2013.01)

(58) Field of Classification Search

USPC ..... 439/40, 39, 505, 38, 822, 504

See application file for complete search history.

(56) References Cited

U.S. PATENT DOCUMENTS

| | | | | |
|---|---|---|---|---|
| 4,390,232 | A * | 6/1983 | Jamgotchian | H01R 11/287 439/38 |
| 4,609,238 | A * | 9/1986 | Jamgotchian | H01R 11/30 439/39 |
| 4,721,479 | A | 1/1988 | Shuman | |
| 4,917,612 | A * | 4/1990 | Priest | H01R 11/287 439/38 |
| 5,602,721 | A | 2/1997 | Slade et al. | |
| 5,779,487 | A * | 7/1998 | Gatin | H01R 11/287 439/39 |
| 5,820,407 | A | 10/1998 | Morse et al. | |
| 5,909,100 | A | 6/1999 | Watanabe et al. | |
| 5,921,809 | A | 7/1999 | Fink | |
| 5,941,729 | A | 8/1999 | Sri-Jayantha | |
| 6,042,385 | A | 3/2000 | Watanabe et al. | |
| 6,364,719 | B1 | 4/2002 | Chopra | |
| 6,575,764 | B1 | 6/2003 | Reipur | |
| 6,692,314 | B1 | 2/2004 | Pares Caselles | |
| 7,206,194 | B2 | 4/2007 | Garner et al. | |
| 7,270,176 | B2 | 9/2007 | Bell et al. | |
| 7,329,128 | B1 | 2/2008 | Awad | |
| 7,351,066 | B2 | 4/2008 | DiFonzo et al. | |
| 7,658,613 | B1 | 2/2010 | Griffin et al. | |

(Continued)

OTHER PUBLICATIONS

Non-Final Office Action mailed Apr. 9, 2015 from U.S. Appl. No. 14/206,908, 12 pages.

(Continued)

*Primary Examiner* — Alexander Gilman

(74) *Attorney, Agent, or Firm* — Rainier Patents, P.S.; Paul W. Mitchell; Remembrance Newcombe

(57) ABSTRACT

This patent pertains to magnetic coupling systems. One implementation includes magnetic jumper cables, which include magnetic couplers and elongate, insulated, electrically-isolated electric conductors.

2 Claims, 11 Drawing Sheets

(56) References Cited

U.S. PATENT DOCUMENTS

| | | | | |
|---|---|---|---|---|
| 7,874,844 | B1 | 1/2011 | Fitts, Jr. | |
| 8,022,664 | B2 | 9/2011 | Shu | |
| 8,076,900 | B1 * | 12/2011 | Brown | F02N 11/14 320/105 |
| 8,083,555 | B2 | 12/2011 | Schouten | |
| 8,529,274 | B2 | 9/2013 | Li et al. | |
| 8,702,594 | B2 | 4/2014 | Edidin et al. | |
| 8,894,419 | B1 | 11/2014 | Buelow | |
| 8,901,877 | B2 * | 12/2014 | Brockman | F02N 11/12 320/105 |
| 8,936,472 | B1 * | 1/2015 | Gibboney, Jr. | H01R 13/6205 439/39 |
| 9,142,912 | B1 | 9/2015 | Allen | |
| 2005/0095907 | A1 | 5/2005 | Ng et al. | |
| 2006/0051981 | A1 | 3/2006 | Neidlein et al. | |
| 2008/0009204 | A1 | 1/2008 | Wei | |
| 2010/0144164 | A1 | 6/2010 | Wang et al. | |
| 2011/0079427 | A1 | 4/2011 | Powale et al. | |
| 2011/0159706 | A1 | 6/2011 | Wu | |
| 2012/0235629 | A1 * | 9/2012 | Wood | H01R 11/288 320/107 |
| 2014/0206244 | A1 | 7/2014 | Kato | |

OTHER PUBLICATIONS

Response filed Jun. 9, 2015 to the Non-Final Office Action mailed Apr. 9, 2015 from U.S. Appl. No. 14/206,908, 9 pages.

Notice of Allowance mailed Jul. 1, 2015 from U.S. Appl. No. 14/206,908, 5 pages.

* cited by examiner

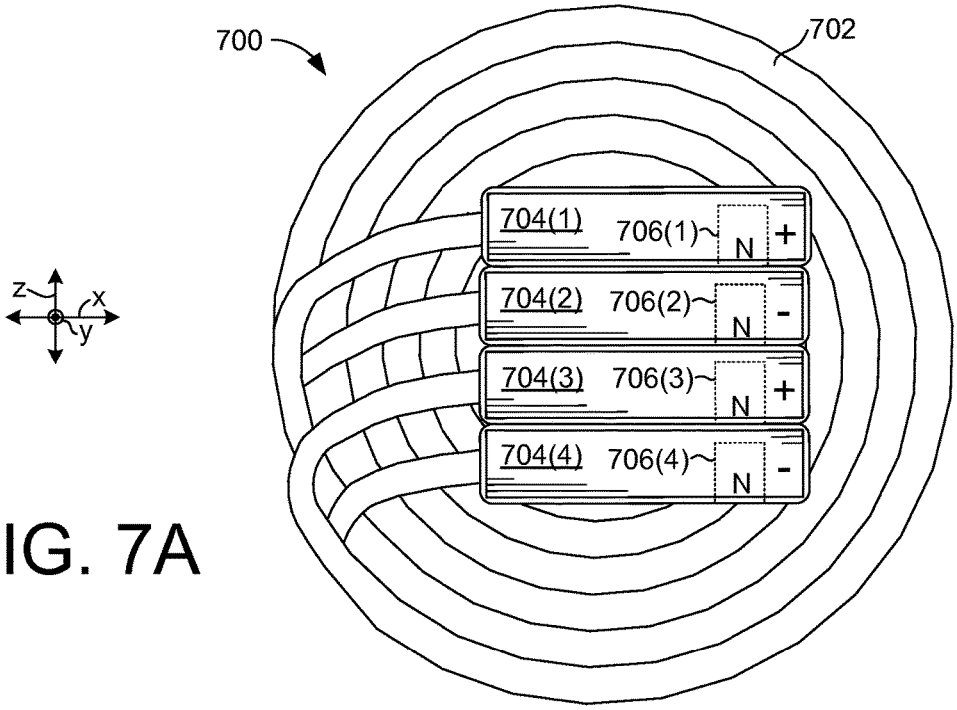
FIG. 7A
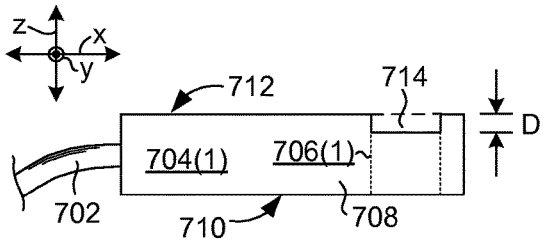
FIG. 7B
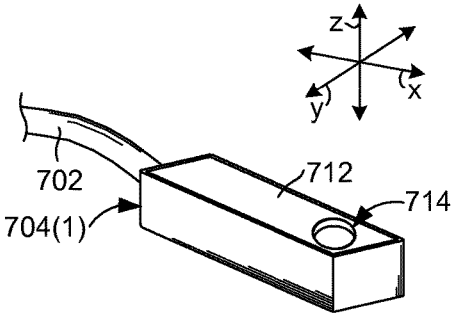
FIG. 7C
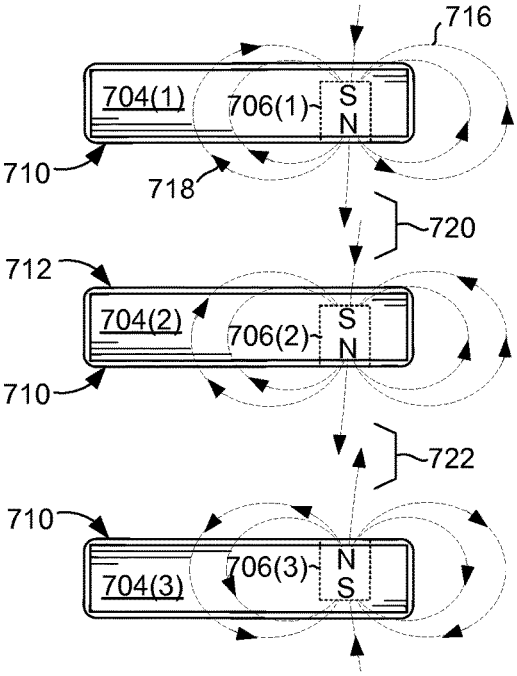
FIG. 7D
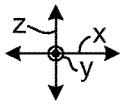

MAGNETIC COUPLING SYSTEMS

CROSS-REFERENCE TO RELATED APPLICATIONS

This patent application is a continuation of, and claims priority to, U.S. patent application Ser. No. 14/206,908, filed on Mar. 12, 2014, which claims priority from U.S. Provisional Patent Application No. 61/782,596, filed on Mar. 14, 2013, which are incorporated herein by reference in their entirety.

PRIORITY

This application is a utility application that claims priority from provisional application 61/782,596 filed 2013 Mar. 14, which is incorporated by reference in its entirety.

BRIEF DESCRIPTION OF THE DRAWINGS

The accompanying drawings illustrate implementations of the concepts conveyed in the present application. Features of the illustrated implementations can be more readily understood by reference to the following description taken in conjunction with the accompanying drawings. Like reference numbers in the various drawings are used wherever feasible to indicate like elements. Further, the left-most numeral of each reference number conveys the figure and associated discussion where the reference number is first introduced.

FIGS. 7A, 7D, and 14 show additional examples of magnetic coupling concepts in accordance with some implementations.

FIGS. 7B, 8A, 8C, and 9A through 13 show sectional views of magnetic jumper cable structures in accordance with some implementations.

FIG. 7C shows a perspective view of magnetic jumper cable structures in accordance with some implementations.

DETAILED DESCRIPTION

Overview

Jumper cables are typically made with alligator type clamps for attaching the cable to the battery terminal. In some cases, the alligator clamp does not attach well to the nut or bolt of the terminal, causing the clamp to detach from the nut/bolt and/or terminal, and therefore also causing the cable to lose physical and electrical contact with the battery. This can be exacerbated by the weight of the cable itself, which can apply torque to the clamp, causing the teeth of the clamp to slip off the nut/bolt and/or terminal.

A better method of attaching the jumper cable to the battery terminal is desirable, both to ensure a secure attachment so that the cable does not slip off the battery terminal, and also to ensure a strong, stable electrical connection between the jumper cable and the battery for better transfer of electrical energy.

Examples

Figure 1:
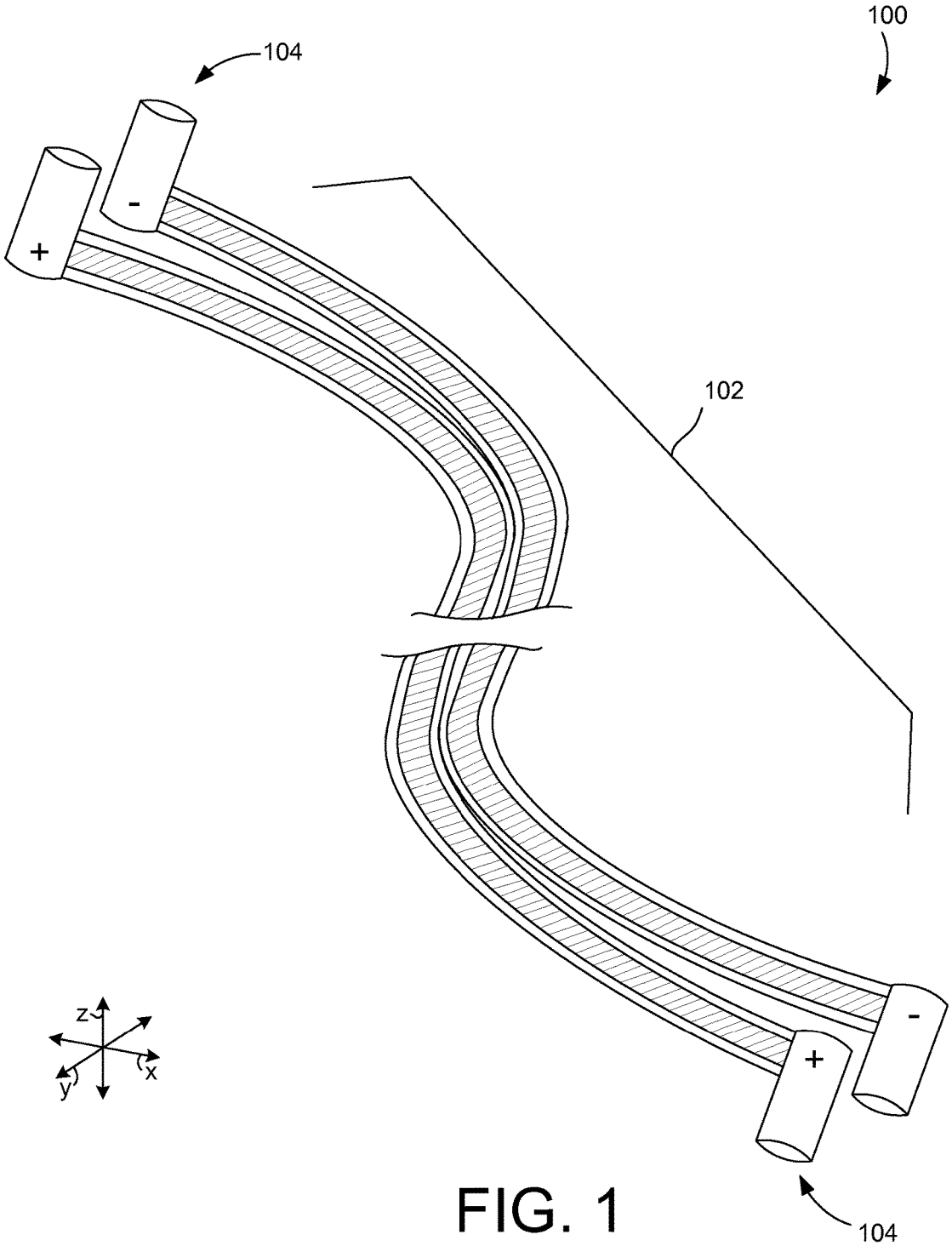
FIGS. 1-2 collectively illustrate magnetic jumper cables in accordance with some implementations of the present concepts.

In one implementation, illustrated in FIG. 1, magnetic jumper cables 100 can include two lengths of elongate, insulated, electric conductor 102 with magnetic couplers 104 on each of the ends of the electric conductors. Individual magnetic couplers can be electrically connected with respective ends of the electric conductors to form a positive ("+") jumper cable and a negative ("−") jumper cable. The magnetic couplers 104 can provide a strong and stable electrical connection between a battery and the electric conductors for better transfer of electrical energy. The electric conductors 102 can be made from suitably conductive material, such as copper wire. The electric conductors can be heavy gauge wire, such as 2-10 gauge, suitable for carrying and transferring high amperage DC current.

The magnetic couplers 104 can provide a more robust physical connection than typical clamp-type jumper cables. For instance, magnetic couplers 104 increase a likelihood that the magnetic jumper cables 100 remain in electrical connection with the batteries, despite torque which may be placed on the connection due to the weight of the wire. The magnetic couplers 104 can also help maintain the physical connection between the magnetic jumper cables 100 and battery terminals despite vibration from the engine of the vehicle with the charged battery used for the jumping. The electric conductors 102 may be any length generally conducive to reaching between a battery from one vehicle to a battery in another vehicle (in FIG. 1 the drawing is shown with a break to indicate additional length of the jumper cables). Also, the electric conductors and/or the magnetic couplers can be colored or have markings to distinguish the positive jumper cable and the negative jumper cable. For example, the positive jumper cable can be red and the negative jumper cable can be black. Alternatively or additionally, the magnetic couplers on the positive jumper cable can be marked with a "+" symbol, for instance.

Figure 2:
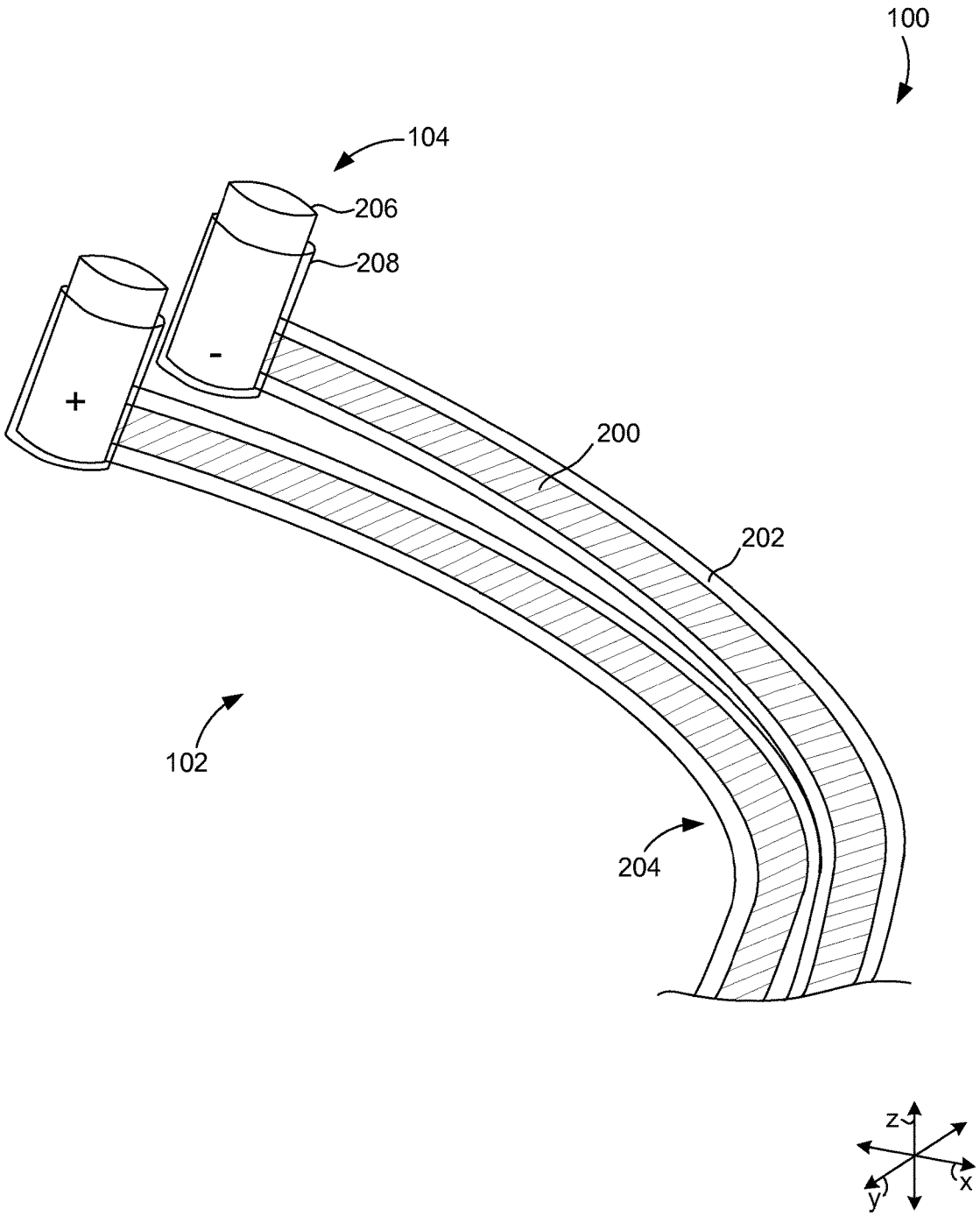

FIG. 2 shows a close-up view of one end of the magnetic jumper cables 100. As illustrated in FIG. 2, the electric conductors 102 can have a core conductive wire 200 and an outer, insulative material 202 surrounding the conductive wire to prevent sparks or shorts. The two lengths of electric conductor 102 can be connected via the insulative material 202 at a point some distance from the ends with the magnetic couplers 104, as shown at 204. The connection can help the magnetic jumper cables from becoming separated from each other. The distance of the connection from the magnetic couplers can be enough so that each magnetic coupler can easily reach a respective battery terminal when in use. In this implementation, the magnetic couplers 104 can include a magnetic element 206 and a protective insulative material 208. The magnetic element can be electrically connected to the conductive wire 200. Some portion of the magnetic elements 206 may be covered with protective insulative material 208 similar or identical to insulative material 202.

Figure 3:
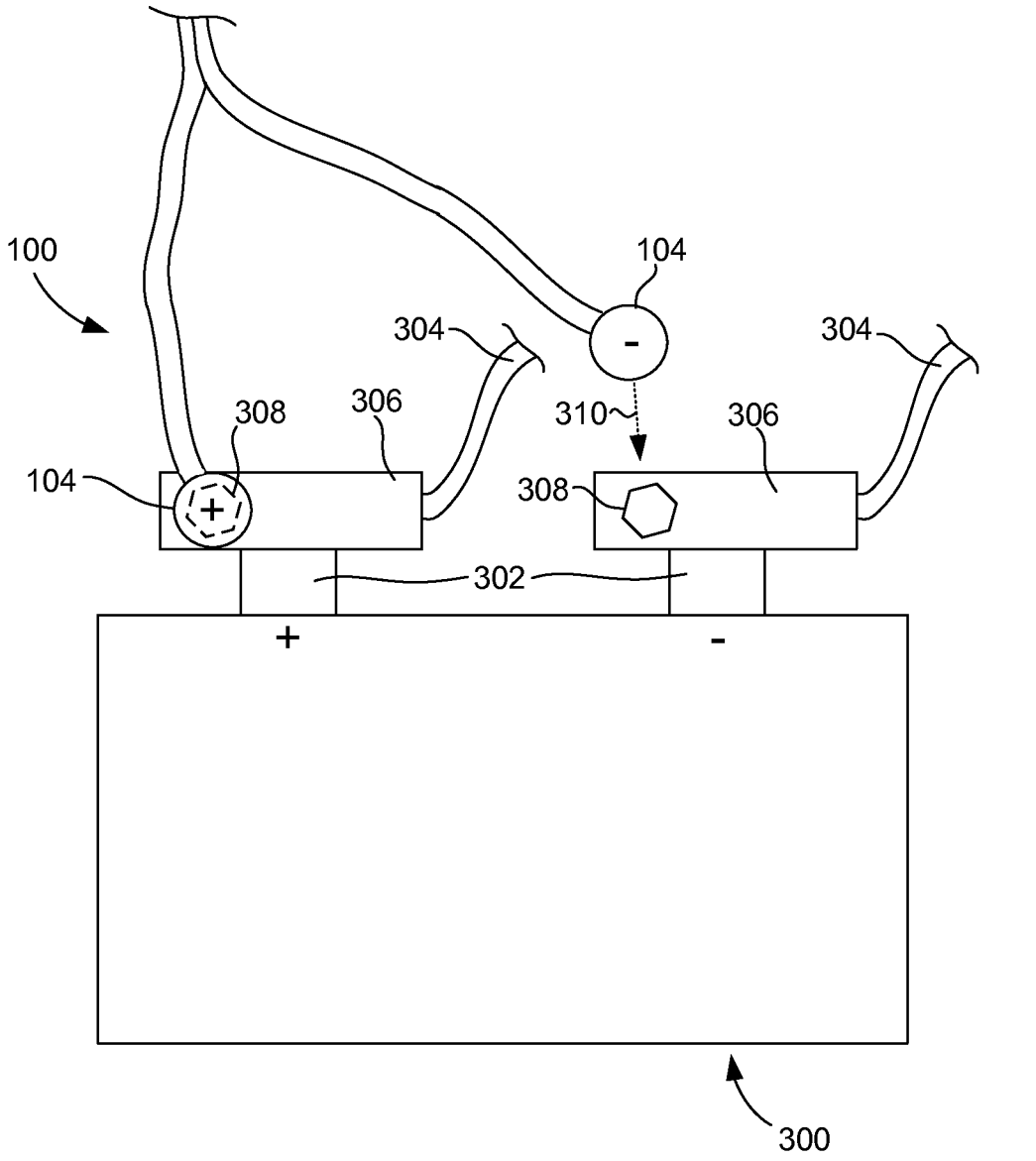
FIG. 3 is a diagram of magnetic jumper cables in use with a battery in accordance with some implementations.
Figure 3:
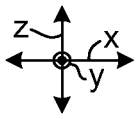

FIG. 3 illustrates an example of the magnetic jumper cables 100 in use with a battery 300. The battery can be an automobile or marine type battery (among others), with "+" and "−" battery terminals 302, power cables 304, power cable clamps 306, and bolts 308 on the power cable clamps, among other configurations. In this example, magnetic coupler 104 can be attached to the power cable clamp 306, such as on the bolt 308. For purposes of explanation, the positive "+" magnetic coupler is attached to the "+" battery terminal. As such, the bolt 308 is shown in ghost (e.g., dashed lines) to indicate that the bolt is blocked from view by the magnetic coupler. The negative "−" magnetic coupler is above the "−" battery terminal and ready to be attached as indicated by arrow 310. When in use, the magnetic couplers can hold the magnetic jumper cable onto the bolts by magnetic attraction, allowing a strong and stable electrical connection.

Figure 4A:
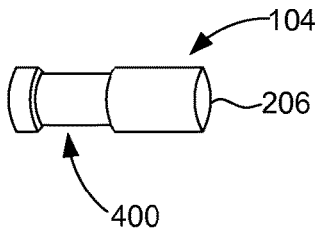
FIGS. 4A-4D are perspective views showing magnetic jumper cable structures in accordance with some implementations.
Figure 4B:
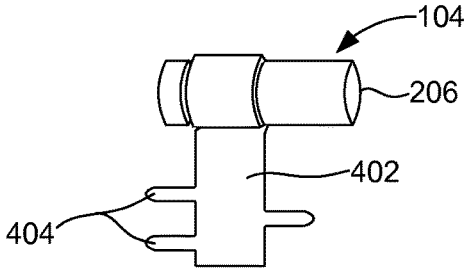
Figure 4C:
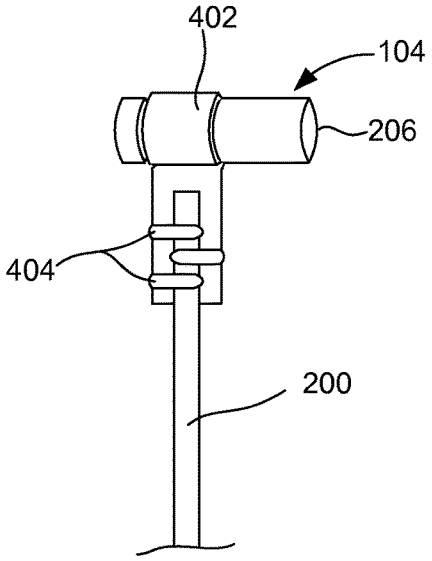
Figure 4D:
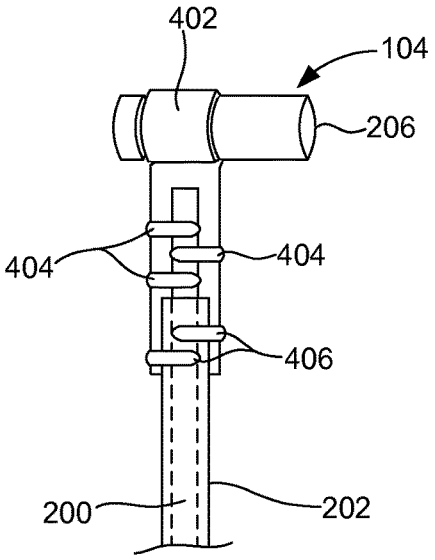
Figure 4D:
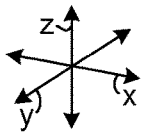

The magnetic couplers 104 may be connected to the conductive wire 200 utilizing various mechanisms. For instance, in the implementation of FIG. 2 the magnetic couplers' magnetic element 206 can be soldered, pressure fitted, or otherwise connected to the conductive wire 200. An alternative configuration is discussed relative to FIGS. 4A-4D. As illustrated collectively in FIGS. 4A-4D, the magnetic element 206 can be designed with an indentation 400, such as a groove, that allows a connecting strap 402 to be fitted to the magnetic element, which in turn can be clamped to the conductive wire 200 with crimps 404. FIG. 4A shows the magnetic coupler 104 prior to attachment, with the indentation 400. FIG. 4B shows the magnetic coupler with the connecting strap 402 fitted around the indentation 400. The connecting strap 402 may be simply pressed around the magnetic element as shown in FIG. 4B, or it can be held in place with a screw or other fastener. Also shown in FIG. 4B are the crimps 404. In FIG. 4C, the conductive wire 200 has been placed on the connecting strap 402 and the crimps have been squeezed around the conductive wire to hold it. In this case the crimps and the connecting strap are made from a conductive material, facilitating electrical connection between the conductive wire and the magnetic coupler. FIG. 4D illustrates an example where the connecting strap 402 can be fitted with additional crimps 406 so that the insulative material 202 surrounding the conductive wire 200 may also be clamped for a more secure connection. The design represented in FIGS. 4A-4D can allow the electric conductor 102 to rotate around the magnetic coupler 104 when the magnetic coupler is connected to a battery terminal. As such, torque forces imposed on the magnetic coupler by the electric conductor 102 can be reduced during use. This can decrease the likelihood that the torque will twist the magnetic coupler off the battery terminal. These torque forces can be substantial with the heavy gauge wire utilized in these high amperage applications.

In some implementations, such as those shown relative to FIG. 3, the magnetic coupler 104 can be shaped so that it fits partially around the head of the bolt 308 to help keep the magnetic coupler in physical connection with the head of the bolt. In one implementation, the magnetic coupler 104 may be shaped in a manner that augments the magnetic attraction of the magnet to the battery terminal or power cable. For instance, the magnetic element 206 (FIG. 2) may have an indentation or a cavity in a face (e.g., the surface that contacts the battery terminal or the power cable) that connects to the bolt 308. In another configuration the magnetic coupler can include a lip that fits over the head of the bolt or other contact surface. In this implementation, the indentation and/or lip can help keep the magnetic coupler from slipping laterally on the surface of the battery terminal, maintaining a more stable physical connection, and therefore a more stable electrical connection.

Figure 5:
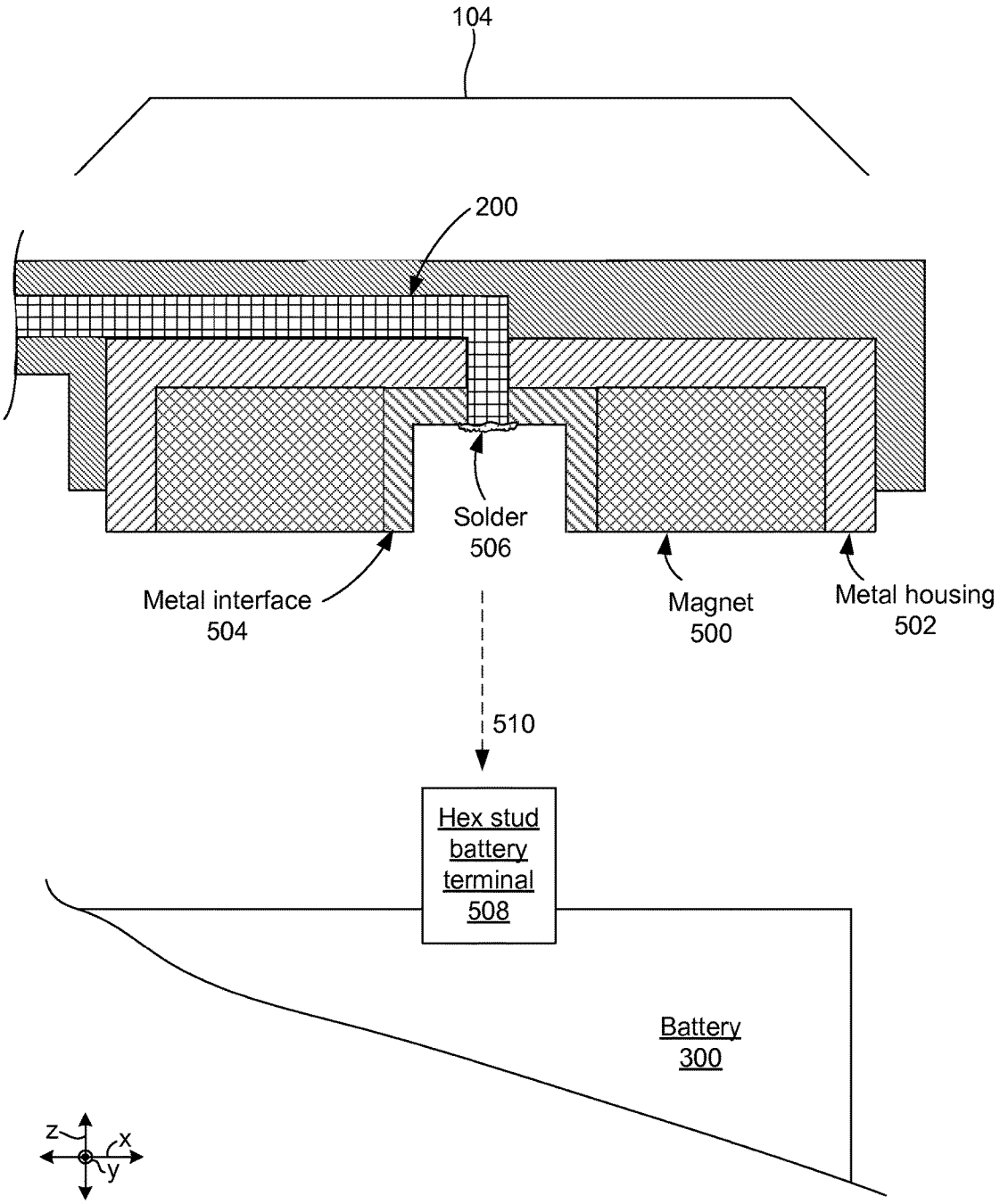
FIG. 5 is a sectional view of magnetic jumper cable structures in accordance with some implementations.

In another case, referring to FIG. 5, the magnetic coupler 104 may include the magnetic element represented as ring magnet 500 and a metal housing 502. In one case, the magnet 500 can be Magnet MMS-B-X4 from K & J Magnetics, Inc. The magnetic coupler can also include metal interface 504, such that the magnet is not in direct contact with a battery terminal. Metal interface 504 can be made from a protective material, such as brass, and can help prevent degradation of the magnet from contact with the battery terminal. The interface material can also be electrically and physically connected to the conductive wire 200. In some cases, the interface material can be a portion of the housing 502. In other cases, the interface material can be in addition to, or used without the housing. In some implementations, solder 506 can be used to secure the conductive wire 200 to the metal interface 504. Of course, other mechanisms can be utilized to secure the conductive wire 200 to the metal interface 504.

In some implementations, any of the elements that make up the magnetic coupler 104, or any combination of those elements, can form a shape that can receive a battery terminal, such as fitting over any protruding part of the battery terminal. The shape can keep the magnetic coupler from slipping laterally on the surface of the battery terminal, maintaining a more stable physical connection, and therefore a more stable electrical connection. As shown in FIG. 5, the metal interface 504 of the magnetic coupler 104 can form a recessed chamber, which can function to receive a hex stud battery terminal 508 on battery 300 by being placed partially over the hex stud battery terminal, as indicated by arrow 510. Other shapes are considered for receiving or fitting a variety of protruding parts of different battery terminal types.

Figure 6:
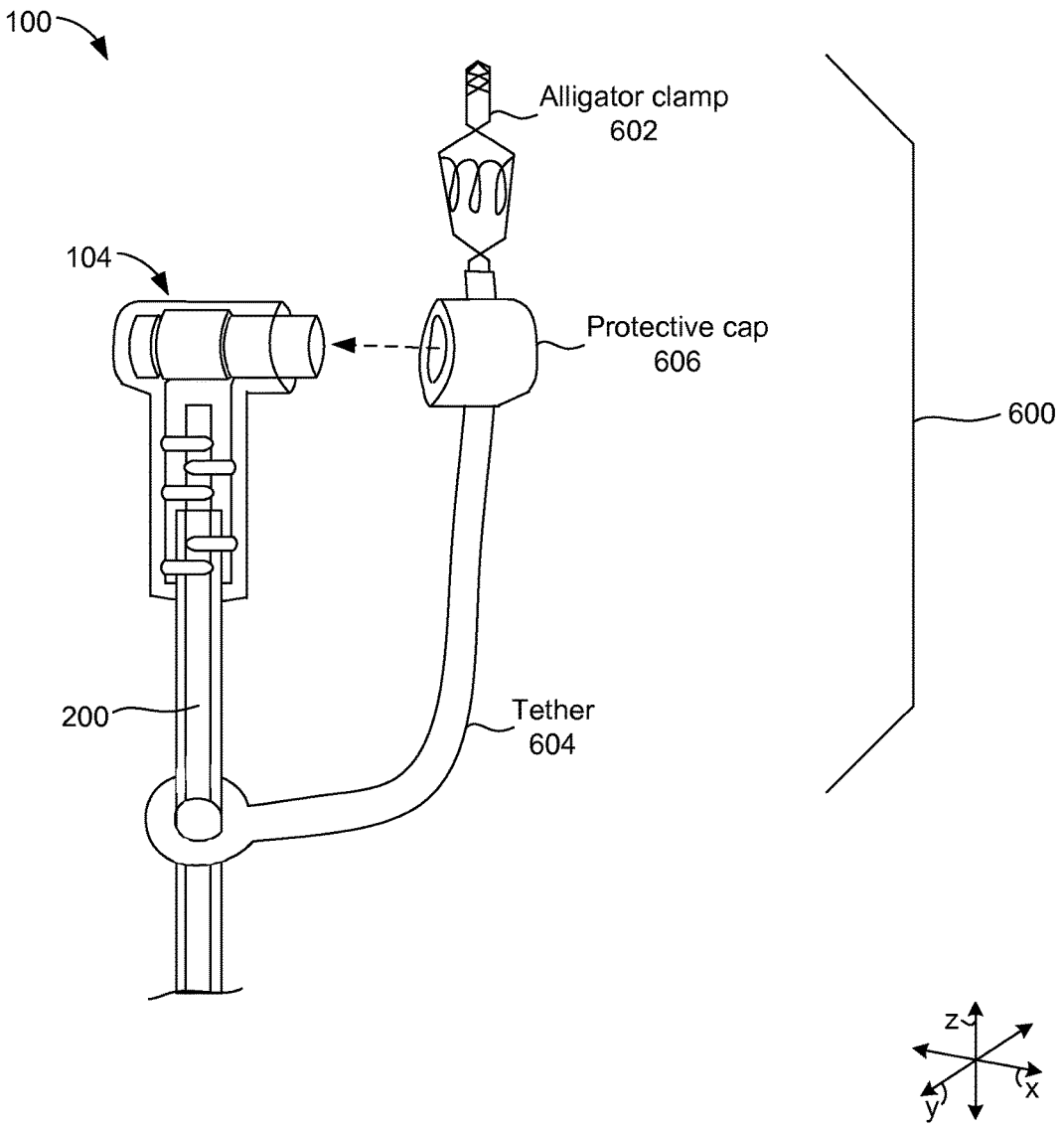
FIG. 6 is a perspective view showing an additional magnetic jumper cable example in accordance with some implementations.

FIG. 6 shows another implementation where the magnetic jumper cables 100 can include a clamp extension 600 in addition to the magnetic coupler 104. The clamp extension can include an electrically conductive clamp, such as an alligator clamp 602, and a tether 604 for attachment to the magnetic jumper cables (e.g., a tether connection between the clamp extension and the magnetic jumper cables). This implementation can be used in instances where the bolt, nut, or other part of the battery terminal is made with a non-magnetic material such that the magnetic coupler is not able to attach. For example, referring to FIG. 3, the power cable clamps 306 or bolts 308 can be formed from non-magnetic materials. For instance, bolt 308 may be an aluminum bolt with an aluminum nut, or some other type of metal that a magnet will not stick to. In this case, referring again to FIG. 6, alligator clamp 602 of the clamp extension 600 can be clamped to the non-magnetic terminal bolt, and the magnetic coupler 104 can be placed on the clamp extension, held to the clamp extension by magnetic attraction. In this configuration, an electrical connection can be completed from the battery terminal and/or the power cable clamps through the clamp extension 600, through the magnetic coupler 104, to the conductive wire 200 of the magnetic jumper cables 100. The clamp extensions help ensure that the magnetic jumper cables can be used with a variety of possible batteries which may need jumping or may be available as the charged battery for the jumping.

The clamp extensions 600 may also be useful in instances where the magnetic coupler 104 may not fit onto a magnetic battery terminal, such as where the shape of the magnetic coupler does not allow it to come into electrical contact with the battery terminal due to the corresponding shape of the battery terminal. A clamp extension may be placed near each end of the conductive wires 200, so that a clamp is available to use with each magnetic coupler. The connection or tether 604 of the clamp extension to the magnetic jumper cable 100 may or may not provide electrical connection between the clamp extension and the conductive wire 200. A clamp extension may be placed on each of the ends of the magnetic jumper cables or on some of the ends.

In some implementations, the magnetic jumper cables 100 can include a protective cap 606 which may be removably positioned over the magnetic coupler 104. The protective cap 606 can prevent unintended electrical connection between the magnetic coupler 104 and parts of the battery terminal, and/or unintended shorting between positive and negative magnetic couplers. Additionally, when a person is in the process of attaching the magnetic jumper cables to a battery or batteries, the protective caps can prevent one magnetic coupler from sticking together with another magnetic coupler as a safety feature that can prevent sparks. As shown in FIG. 6, the protective cap 606 can be attached to the clamp extension 600 to minimize the number of extensions on the magnetic jumper cables 100. The protective cap may be made of rubber, or another suitable non-conductive material. A protective cap may be placed on each of the ends of the magnetic jumper cables or attached to each of the clamp extensions, or may be placed on some of the ends of the magnetic jumper cables.

The magnetic jumper cables 100 can be made to use on any type of automobile, truck, or recreational vehicles such as boats, jet skis, ATVs, among others.

FIGS. 7A through 7D collectively illustrate another implementation of magnetic jumper cables 700 that are similar to the magnetic jumper cables 100 introduced above relative to FIG. 1. In the implementation shown in FIGS. 7A-7D, magnetic jumper cables 700 can include two lengths of elongate, insulated, electric conductor 702 with magnetic couplers 704 on each of the ends of the electric conductors. (The two lengths are electrically isolated from one another). FIG. 7A is a view of the magnetic jumper cables showing the electric conductor 702 coiled and the four magnetic couplers 704(1), 704(2), 704(3), and 704(4) on each of the ends of the electric conductors. The magnetic couplers 704 can include magnetic elements 706. The position of magnetic element 706 within the magnetic coupler 704 is shown in dotted lines.

The four magnetic couplers 704(1), 704(2), 704(3), and 704(4) are magnetically-attractively stacked against each other. Note that the elongate, insulated, electric conductors 702 are stacked vertically in the coil and are only distinguishable near the magnetic couplers. Note also that different instances of the magnetic couplers in FIG. 7A are distinguished by parenthetical references, e.g., 704(1) refers to a different magnetic coupler than 704(2). When referring to multiple elements collectively, the parenthetical will not be used, e.g., magnetic couplers 704 can refer to either or all of magnetic coupler 704(1), magnetic coupler 704(2), magnetic coupler 704(3), and magnetic coupler 704(4).

Similar to other implementations described above, individual magnetic couplers 704 can be electrically connected with respective ends of the electric conductors 702 to form a positive ("+") jumper cable (e.g., magnetic couplers 704(1) and 704(3)) and a negative ("−") jumper cable (e.g., magnetic couplers 704(2) and 704(4)). The positive and negative jumper cable can be collectively referred to as a set of jumper cables. Note also that in FIG. 7A each magnetic element is oriented in the magnetic coupler with the same magnetic orientation (e.g., note the "N" for north pole on each magnetic element 706). This aspect is discussed in more detail below.

FIG. 7B is a cross-sectional view of the magnetic coupler 704(1) showing the magnetic element 706(1) and insulative material 708. As shown in the example in FIGS. 7A and 7B, the magnetic elements 706 are generally positioned within the magnetic couplers 704 such that the magnetic elements are flush with a flat side 710 (e.g., first side) of the magnetic couplers, or the lower edge of the magnetic couplers with respect to the z reference axis. Also, in this implementation the magnetic elements do not extend to an indented side 712 (e.g., second side) of the magnetic couplers, or the upper edge with respect to the z reference axis. This leaves an indentation 714 on the indented side 712 of the magnetic coupler, as shown in FIG. 7C. For purposes of explanation, from one perspective, the indentation 714 can have a depth D (in the z reference direction) such that electricity at normally encountered battery voltages (such as 12 or 24 volt) does not readily jump across from a conductor placed at the surface of the indented side 712 to the magnetic element 706(1).

In some implementations magnetic poles of the magnetic elements 706 can be oriented within the magnetic couplers 704 such that the flat sides 710 (e.g., exposed magnet sides) of two magnetic couplers repel, rather than attract, each other. Since the magnetic element is shrouded on all sides except the flat side 710 with insulative material 708, this can prevent unwanted electrical connection between charged magnetic couplers. Additionally, the attraction of opposite sides of the magnetic elements can also facilitate a compact arrangement (e.g., stacking) of the magnetic couplers and/or the magnetic jumper cables, such as for storage or packaging (as shown in FIG. 7A). For example, the magnetic attraction of the opposite sides of the magnetic couplers can cause them to gently "snap" or click together (north to south, north to south without forming an electrical connection).

The orientations of the magnetic fields of the magnetic elements will now be explained further with reference to FIGS. 7A and 7D. As shown in FIG. 7A, the magnetic element 706(1) in magnetic coupler 704(1) can be oriented such that a "north" magnetic pole N is facing downward on the magnetic coupler with respect to the z reference axis. Stated another way, in this case the north magnetic pole N is flush with the flat side 710 of magnetic coupler 704(1) (shown but not designated). Similarly, in this case the north magnetic poles N of each of the magnetic couplers 704(2), 704(3), and 704(4) are also facing downward with respect to the z reference axis (e.g., oriented the same). Of course, in other instances of the magnetic jumper cables the north magnetic pole of the magnetic elements may be aligned upwards with respect to the z reference axis in FIG. 7A. Other orientations of the magnetic elements within the magnetic couplers or between different magnetic couplers on the same instance of magnetic jumper cables are contemplated.

FIG. 7D shows three instances of magnetic couplers, specifically magnetic couplers 704(1), 704(2), and 704(3). In this example, the flat sides 710 of magnetic couplers 704(1) and 704(2) are oriented downwardly facing with respect to the z reference axis, the same as FIG. 7A. Conversely, the flat side 710 of magnetic coupler 704(3) is oriented upwardly facing with respect to the z reference axis in FIG. 7D. Also illustrated in FIG. 7D are magnetic field lines, shown as dashed lines (e.g., magnetic field line 716). The directions of the magnetic field lines are indicated with arrows (e.g., arrow 718). Only one of the magnetic field lines and one of the arrows are designated to avoid clutter on the drawing page.

As indicated by the arrows, the direction of the magnetic field is away from the north magnetic pole N of the magnetic element and toward the south magnetic pole S of the magnetic element. For example, as noted above, the magnetic element 706(1) within magnetic coupler 704(1) is oriented with the north magnetic pole N on the flat side 710 (e.g., lower side in FIG. 7D). Accordingly, in this case the magnetic field is directed down from the magnetic element with respect to the z reference axis. The orientation of the magnetic element 706(2) within magnetic coupler 704(2) is the same as the magnetic element 706(1) within magnetic coupler 704(1). Therefore, since both magnetic coupler 704(1) and magnetic coupler 704(2) have flat sides 710 facing the same direction, the direction of the magnetic field lines are aligned as indicated at 720. Accordingly, the flat side of magnetic coupler 704(1) is generally attracted to the indented side 712 of magnetic coupler 704(2). However, since in this case the flat side of magnetic coupler 704(3) is facing upward with respect to the z reference axis, and therefore facing the flat side of magnetic coupler 704(2), the direction of the magnetic field lines are in conflict as indicated at 722, and the exposed magnetic elements generally repel one another. Thus, when the magnetic elements are positioned within the magnetic couplers with the same orientation with respect to their associated magnetic fields, the sides of the magnetic couplers with the exposed magnetic elements will generally repel one another, and avoid an unwanted electrical connection (e.g., short).

Note that although the magnetic element 706 is exposed within the indentation 714 on the indented side 712 (as shown in FIGS. 7B and 7C), another magnetic coupler is not able to fit within the indentation in any way that would allow contact between the magnetic elements. Therefore, in this case the magnetic couplers are effectively shrouded on all sides except the flat side 710 that has the exposed magnetic element.

Viewed from one perspective, one aspect of this implementation is that all of the magnetic elements 706(1)-706(4) are oriented the same way within the insulative material 708 and only one surface of the magnetic element 706 (e.g., one pole of the magnetic element) is exposed at a surface level of the magnetic coupler 704.

Figure 8A:
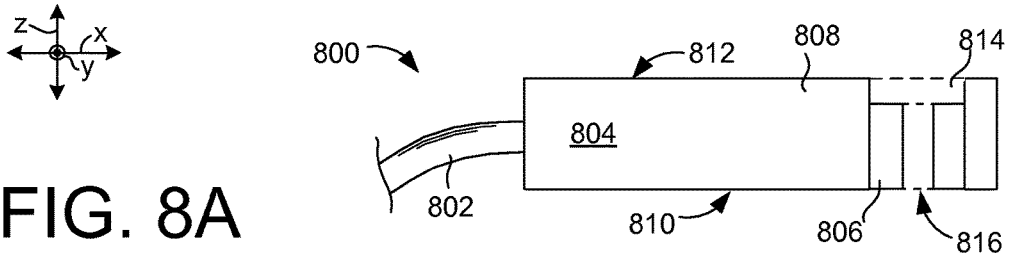
Figure 8B:
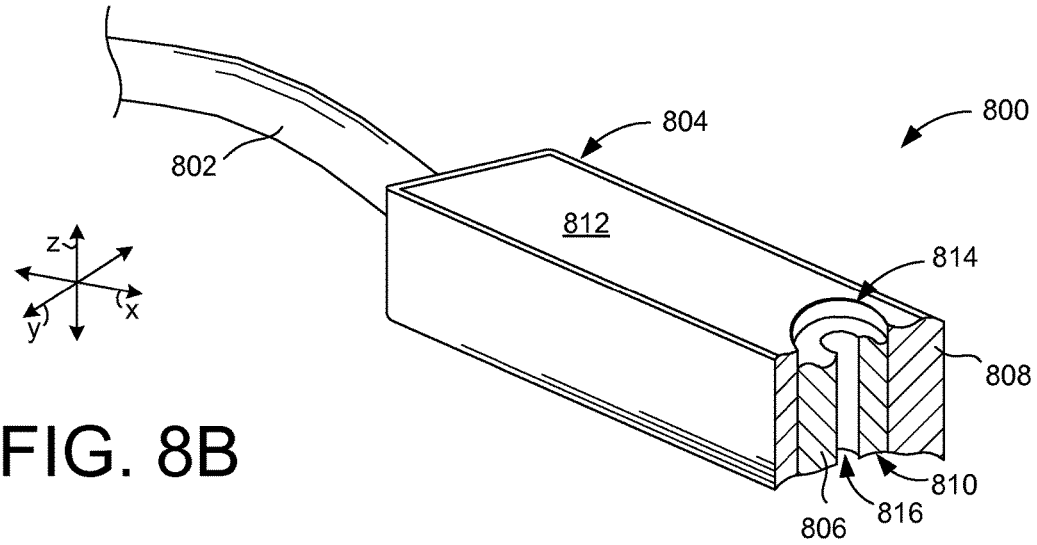
FIG. 8B is a cut-away perspective view of magnetic jumper cable structures in accordance with some implementations.
Figure 8C:
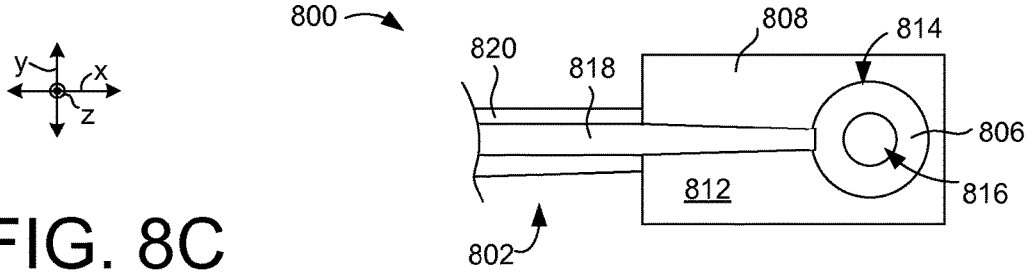

Another example of magnetic jumper cables 800 is collectively illustrated in FIGS. 8A-8C and 9A-8D. FIG. 8A is a cross-sectional view cut along the x-z plane of the reference axes. FIG. 8B is a perspective, cut-away view. FIG. 8C is a cross-sectional view cut along the x-y plane of the reference axes. This implementation includes at least one elongate, insulated, electric conductor 802 with a magnetic coupler 804 on at least one end. Magnetic coupler 804 is similar to magnetic coupler 704 in that it includes a magnetic element 806, insulative material 808, a flat side 810, an indented side 812, and an indentation 814. However, in this case, the magnetic element 806 also has a hole 816, such that the magnetic element resembles a donut shape. As seen in FIG. 8B, the hole extends along the z reference axis, so that the hole is open from the indentation 814 all the way through the magnetic coupler to the flat side 810.

As shown in FIG. 8C, the electric conductor 802 can have a core conductive wire 818 and an outer, insulative material 820 surrounding the conductive wire to prevent sparks or shorts. The magnetic element 806 can be electrically connected to the conductive wire 818, such as by soldering and/or fasteners. In the illustrated configuration, strands of conductive wire 818 can extend slightly into indentation 814 (which at this point can extend all the way through the insulative material and be slightly tapered. The magnetic element can be pressure fit into the indentation to contact the strands of conductive wire thereby locking the magnetic element and the strands in place as well as electrically connecting the strands and the magnetic element. This process can leave the remaining indentation 814 illustrated in FIGS. 8A-8B. In other implementations, the magnetic couplers can include other structures, such as a housing and/or interface similar to structures shown in FIG. 5.

As illustrated in FIGS. 9A through 9D, the magnetic jumper cables 800 can be connected via the magnetic couplers 804 to a variety of shapes and/or sizes of exposed and/or protruding structures associated with battery terminals. For convenience, FIG. 8A is repeated on the drawing page as FIG. 9A, except the magnetic coupler is upside-down, or facing the opposite direction with respect to the z reference axis. For example, in FIG. 9A the indented side 812 is facing downward with respect to the z reference axis.

Figure 9A:
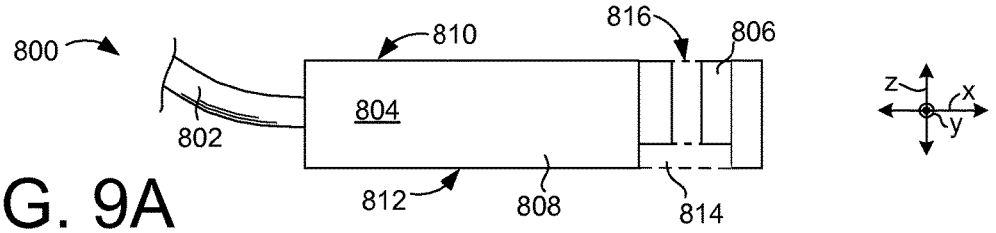
Figure 9B:
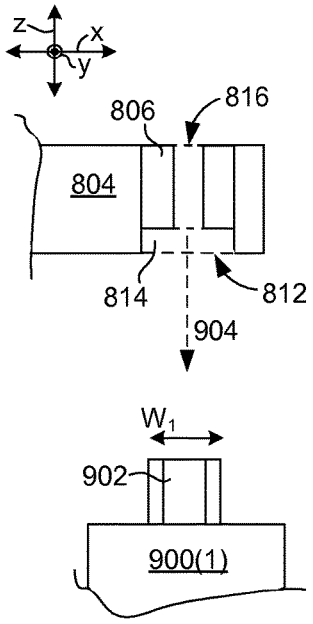
Figure 9C:
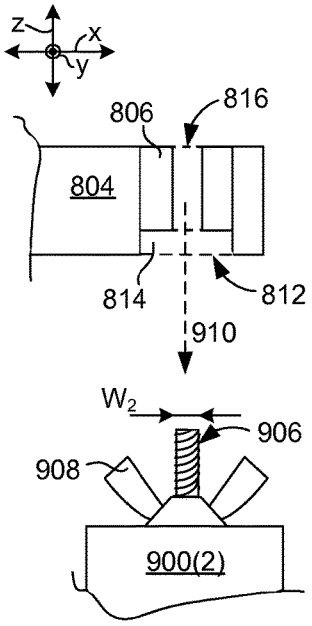
Figure 9D:
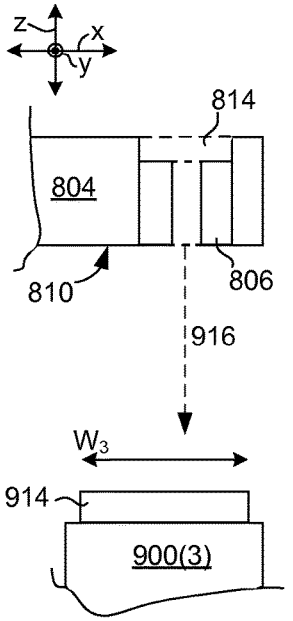

FIGS. 9B through 9D collectively illustrate examples of how the magnetic coupler 804 can be connected to a battery terminal using either the indented side 812 or the flat side 810. The side chosen for connection can depend on the size and/or shape of the exposed structure associated with a battery terminal. For example, FIG. 9B shows a battery terminal 900(1) manifest as a hex bolt or stud 902. The indentation 814 on the indented side 812 of the magnetic coupler 804 can be fit over hex bolt 902, as indicated at arrow 904. In this case, a width $W_1$ of the exposed head of the hex bolt 902 can be narrow enough to fit into the indentation 814 such that the magnetic element 806 can contact the hex bolt and help secure it by magnetic attraction. However, in this case the exposed head of the hex bolt is too wide to fit into the hole 816 through the magnetic coupler. The fit of the indentation over the head of the hex bolt can also help secure the connection between the magnetic coupler and the hex bolt, such that the magnetic coupler is less likely to slip laterally (e.g., along the x reference axis) off the hex bolt. Therefore, the magnetic attraction and the fit of the indentation over the head of the hex bolt can help provide a strong electrical connection between the conductive wire of the magnetic jumper cables and the battery terminal.

FIG. 9C shows a second example connection. In this example, battery terminal 900(2) can have a threaded post 906 and wing nut 908. The indented side 812 of the magnetic coupler 804 can be fit over the threaded post 906, as indicated at arrow 910. In this case, a width $W_2$ of the exposed end of the threaded post 906 can be narrow enough to fit into the indentation 814 and also narrow enough to fit into the hole 816 through the magnetic coupler. In this example, the magnetic element 806 can contact the threaded post 906. This is another example of a secure physical connection between the magnetic coupler and an exposed structure associated with a battery terminal, facilitating a good electrical connection.

FIG. 9D shows a third example connection. In this example, a battery terminal 900(3) can have a flat, exposed portion 914. In this case, a width $W_3$ of the exposed portion 914 is too wide to fit into indentation 814 on the magnetic coupler 804. Alternatively, the flat side 810 of the magnetic coupler can be laid against (e.g., stuck to) the exposed portion 914 as indicated at arrow 916. In this case, the magnetic nature of the magnetic coupler helps hold the flat side against the exposed portion, assisting with the electrical connection between the magnetic jumper cables 800 and the battery terminal 900. The flat side of the magnetic coupler can be used when the shape and/or size of the exposed structure associated with a battery terminal is not conducive to connection with an indentation and/or hole of the magnetic coupler.

Figure 10:
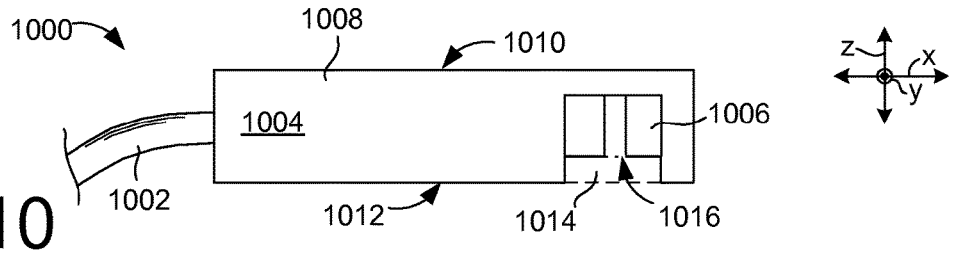

Of course, other configurations of the magnetic coupler are contemplated. For example, FIGS. 10-13 show some other configurations of magnetic jumper cables 1000 that can include an elongate, insulated electric conductor 1002 electrically coupled to a magnetic coupler 1004. The magnetic coupler 1004 can include a magnetic element 1006 and insulative material 1008. In the configuration of FIG. 10, the magnetic coupler 1004 can also include a flat side 1010, an indented side 1012, an indentation 1014, and a hole 1016. However, in this case the hole 1016 does not extend all the way through the magnetic coupler 1004. Alternatively, the flat side 1010 of the magnetic coupler 1004 can be solidly covered with the protective, insulative material 1008, with no exposed hole.

Figure 11:
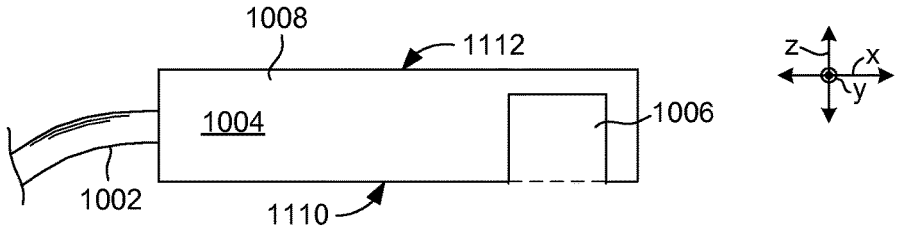

In the configuration of FIG. 11 the magnetic element 1006 is completely surrounded by insulative material 1008 except one surface of the magnetic element is exposed on the first side 1110 and not on a second opposing side 1112. As explained above, in this implementation the magnetic elements can be oriented the same way in each of the magnetic couplers 1004 to reduce the likelihood of electrical shorts across the magnetic couplers.

Figure 12:
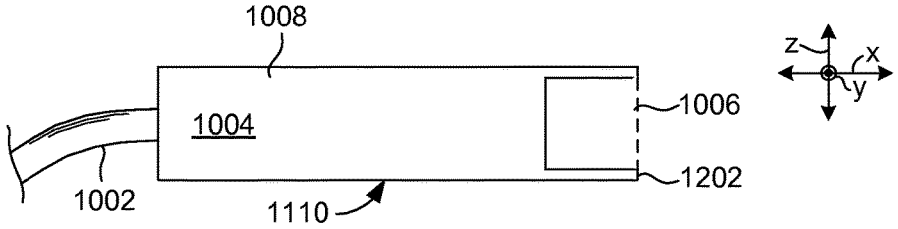

FIG. 12 shows a configuration where the magnetic element 1006 is exposed on a surface 1202 of the magnetic coupler 1004 that is generally perpendicular to insulated electric conductor 1002 where the insulated electrical conductor enters the magnetic coupler 1004.

Figure 13:
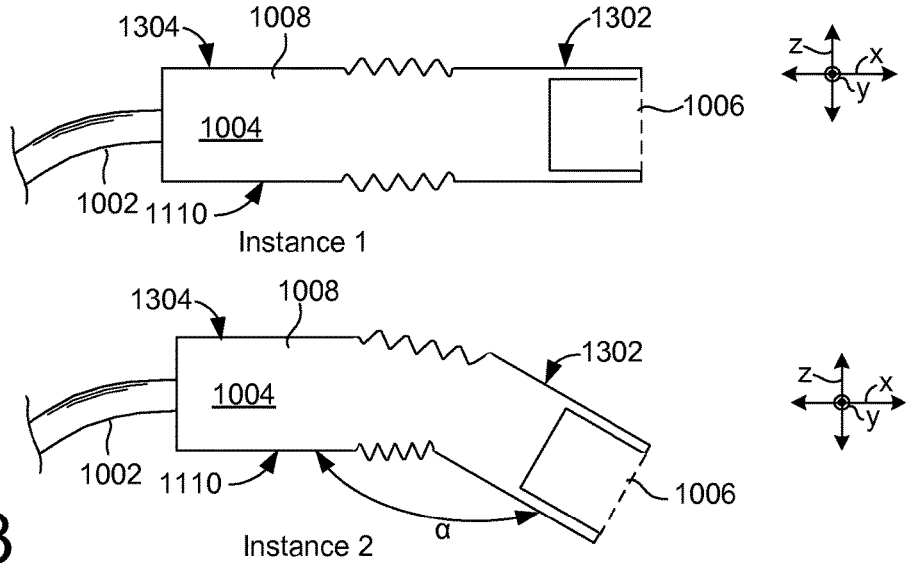

FIG. 13 shows still another configuration where the magnetic coupler 1004 is flexible so that a user can bend a portion 1302 of the magnetic coupler containing the magnetic element 1006 relative to a remainder 1304 of the magnetic coupler (e.g., compare instance 1 to instance 2). For example, the portion may be able to bend the portion at an angle $\alpha$ of +/−120 degrees, among other ranges.

In summary, in the implementations described relative to FIGS. 7A-13, only one pole of the magnet element in each magnetic coupler is exposed at the surface of the magnetic coupler and all of the magnet elements are oriented the same (e.g., all North poles exposed or all South poles exposed). This configuration can reduce the likelihood of the magnetic couplers accidentally coming in contact with one another and creating a short circuit. This configuration can also allow convenient magnetic stacking (see FIG. 7A) that can reduce tangling of the magnetic jumper cables. Of course, other configurations are contemplated.

The example magnetic couplers described in the above examples have generally included cylindrically-shaped magnetic elements. In other implementations, the magnetic element can have any of a variety of other shapes and/or sizes, such as a rectangular box shape, or an irregular and/or asymmetrical shape. Similarly, the insulative material portion of the magnetic couplers can have any of a variety of shapes and/or sizes. In some implementations, the magnetic couplers can include indentations and/or holes, which can be any of a variety of sizes and/or shapes to receive a variety of sizes and/or shapes associated with battery terminals or other electrical connections. Further, the indentations and/or holes can be partial (as shown in FIG. 10) or run all the way through the magnetic coupler (such as hole 816 shown in FIG. 8B). Additionally, each of the magnetic couplers on one instance of magnetic jumper cables can have the same configuration (e.g., structure, shape, size, magnetic pole orientation, colors, markings), or magnetic couplers on the same instance of magnetic jumper cables can have different configurations. Further, the present implementations can be constructed with any materials known in the art, such as various polymer insulators and conductors such as copper or aluminum, to provide the elongate portion of the magnetic jumper cables and with or without various fittings connecting the magnetic elements to the conductors. For instance, the insulator, molded or otherwise formed around the magnet and the conductor may sufficiently physically and electrically secure them together.

Figure 14:
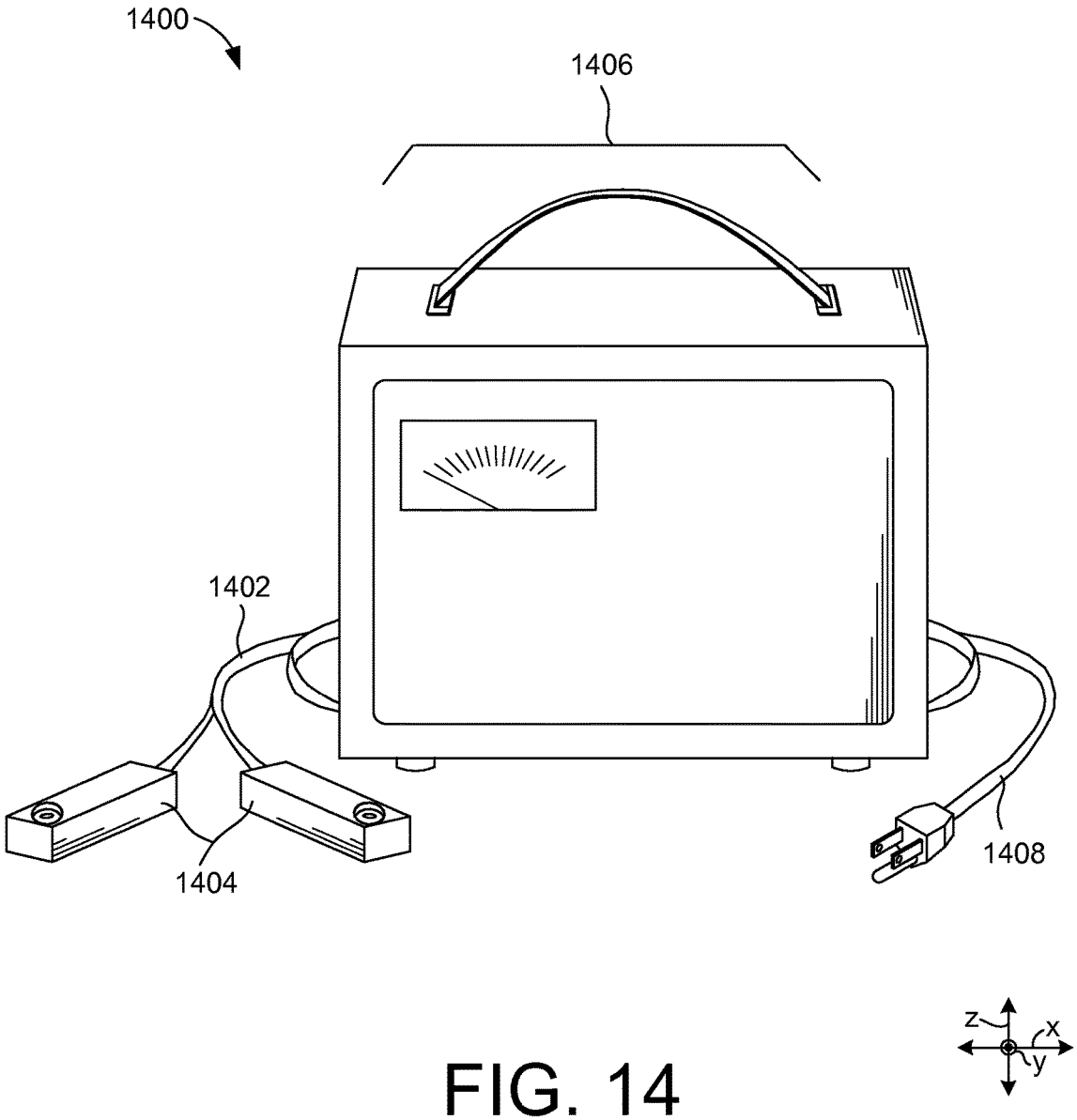

FIG. 14 illustrates an example of a magnetic coupling apparatus 1400. In this example, the magnetic coupling apparatus 1400 is manifest as a battery charger (e.g., power source). Magnetic coupling apparatus 1400 can include elongate, insulated electric conductors 1402 (e.g., cables, wires) and magnetic couplers 1404 (e.g., connectors). The magnetic coupling apparatus can also include a battery charger box 1406 and a power cord 1408. The battery charger and/or battery charger box can have a variety of sizes and/or shapes, and can include a variety of additional features, such as a handle and an analog meter (shown but not designated). The magnetic couplers 1404 can be used to connect the battery charger to battery terminals on a battery, and the power cord 1408 can be plugged in to a power supply to charge the battery (not shown). Of course, the magnetic coupling apparatus 1400 can also be manifest as a set of jumper cables or as any other type of apparatus.

CONCLUSION

Although techniques, methods, devices, systems, etc. pertaining to magnetic coupling systems are described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

The invention claimed is:

1. A set of magnetic jumper cables, comprising:

a first pair of positive magnetic couplers connected by a first insulated elongate electrical conductor; and a second pair of negative magnetic couplers connected by a second insulated elongate electrical conductor, the first and second insulated elongate electrical conductors being at least partially co-extensive, wherein each of the magnetic couplers includes a magnetic element partially surrounded by insulative material, and wherein each of the magnetic elements is oriented in a same magnetic orientation in the insulative material, and wherein a single surface of each of the magnetic elements is flush with a first side of the insulative material, and wherein a second surface of each of the magnetic elements is recessed from but open to a second opposite side of the insulative material.

2. A set of magnetic jumper cables, comprising:

two lengths of elongate, insulated, electrically-isolated electric conductors; and magnetic couplers configured in electrical connection with at least one end of each of the two lengths of elongate, insulated, electric conductors, wherein an individual magnetic coupler includes:

an insulative material, and a magnetic element, wherein the magnetic element is positioned within the insulative material such that:

the magnetic element is in electrical connection with a corresponding elongate, insulated, electrically-isolated electric conductor, a north magnetic pole and a south magnetic pole of the magnetic element are each oriented toward opposing sides of the individual magnetic coupler, and one of the opposing sides of the individual magnetic coupler defines an indentation in the insulative material, the indentation extending to the magnetic element.

* * * * *